US008573229B2

(12) United States Patent
Mehio

(10) Patent No.: US 8,573,229 B2
(45) **Date of Patent: *Nov. 5, 2013**

(54) MULTIPLE PORT, PRESSURE-RESPONSIVE ADJUSTABLE HOOKAH

(75) Inventor: Nizar Youssef Mehio, Telet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 1140 days.

This patent is subject to a terminal disclaimer.

(21) Appl. No.: 12/489,114

(22) Filed: Jun. 22, 2009

(65) Prior Publication Data

US 2009/0301502 A1 Dec. 10, 2009

Related U.S. Application Data

(63) Continuation of application No. 11/201,274, filed on Aug. 11, 2005, now abandoned.

(51) Int. Cl.
*A24F 1/14* (2006.01)
*A24F 1/30* (2006.01)

(52) U.S. Cl.
USPC ..... 131/173; 131/201; 131/207; 131/331; 131/512

(58) Field of Classification Search
None
See application file for complete search history.

(56) References Cited

U.S. PATENT DOCUMENTS 7,806,123 B2 * 10/2010 Mehio ..... 131/173

* cited by examiner

*Primary Examiner* — Richard Crispino
*Assistant Examiner* — Phu Nguyen
(74) *Attorney, Agent, or Firm* — Da Vinci's Notebook, LLC

(57) ABSTRACT

A smoking apparatus includes a stem having a base at a lower end thereof coupled to a bottle containing a fluid and a neck extending upwardly from the base. A central passage extends through the stem from a burner cup disposed atop the neck to the interior of the cup. Smoking hoses are connected to the stem to permit users to draw smoke from the burner cup, through the central passage, through the water, and out of the hose. The hoses are connected to the stem by one-way fittings which permit air to be drawn out of the bottle and into the hose, but prevent air from being drawn through the hose and into the bottle.

4 Claims, 5 Drawing Sheets

MULTIPLE PORT, PRESSURE-RESPONSIVE ADJUSTABLE HOOKAH

RELATED APPLICATIONS

This application is a continuation of, and claims priority under 35 U.S.C. §120 from, U.S. patent application Ser. No. 11/201,274, filed Aug. 11, 2005 now abandoned, the disclosure of which is incorporated herein by reference.

The invention relates to a smoking apparatus, and more particularly, to a smoking apparatus that may be smoked by more than one smoker at a time.

BACKGROUND

Pipes are often used to smoke materials such as tobacco. Moisture from a fluid may be mixed with the pipe smoke to ameliorate harshness and to impart a pleasant flavor or aroma to the smoke. So-called hookah pipes are smoking apparatuses which mixed pipe smoke with moisture.

A hookah pipe has a bottle containing fluid. The bottle may be made of glass, such as crystal. A stem is mounted to the bottle. The stem includes a passage conveying smoke from a burner cup on top of the stem through a down tube projecting from the stem and into the fluid in the bottle. The stem is preferably made of metal. The smoke drawn through the stem is expelled from the down tube beneath the surface of the fluid and allowed to bubble up through the fluid to the surface, absorbing moisture as it rises to the fluid surface. A second passage formed within the stem conveys the now-moistened smoke out to a hose. A smoker smokes the hookah pipe by drawing smoke through the hose.

Hookah pipes may have a plurality of hoses—each with a separate fitting connecting them to the stem—thereby permitting multiple smokers to use the pipe. The stopper prevents air from being drawn through an unused fitting into the stem when the smoker inhales, bypassing the burner and destroying the draft. If, on the other hand, the hookah pipe is intended to be smoked by more than one smoker, each smoker is provided with a separate hose. Multiple smokers smoke the hookah pipe by inhaling alternately through their respective hoses. Smokers who are not currently inhaling may squeeze their hoses to block them, preventing air from being drawn through them down into the stem while the other smoker is inhaling. If one of the non-inhaling users forgets to pinch off his hose, or does so inadequately, the inhaling smoker will draw mostly smokeless air through the open hose, rather than smoke through the burner cup.

SUMMARY

A primary object of the invention is to overcome the deficiencies of the related art described above by providing a multiple-user smoking apparatus.

The invention is embodied in a smoking apparatus comprising a bottle, with a stem attached thereto with a burner cup mounted atop the stem, and smoking hoses connected to the stem by one-way flow fittings. When one smoker is using the pipe, the unused hoses are disconnected and the fittings may be replaced with, for example, a stopper or a pressure-release valve. The bottle contains a fluid and has an opening at an upper end thereof. The stem has a base and a neck extending upwardly from the base with a central passage extending through the base and the neck. A down tube extends from said base in communication with the central passage. The based is secured to the bottle with the down tube extending through the opening of the bottle with a terminal end of the down tube disposed beneath the surface of the fluid contained in the bottle. Two or more one-way flow fittings are secured to the stem in communication with an interior of the bottle, and each one-way flow fitting is constructed and arranged to permit air flow out of the interior of the bottle through the fitting and to restrict air flow into the interior of the bottle through the fitting. A hose is connected to each one-way flow fitting and is constructed and arranged to permit a user to draw on one end of the hose to draw air through the burner cup, through the central passage and down tube, through the fluid contained in the bottle, and into the user's hose.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
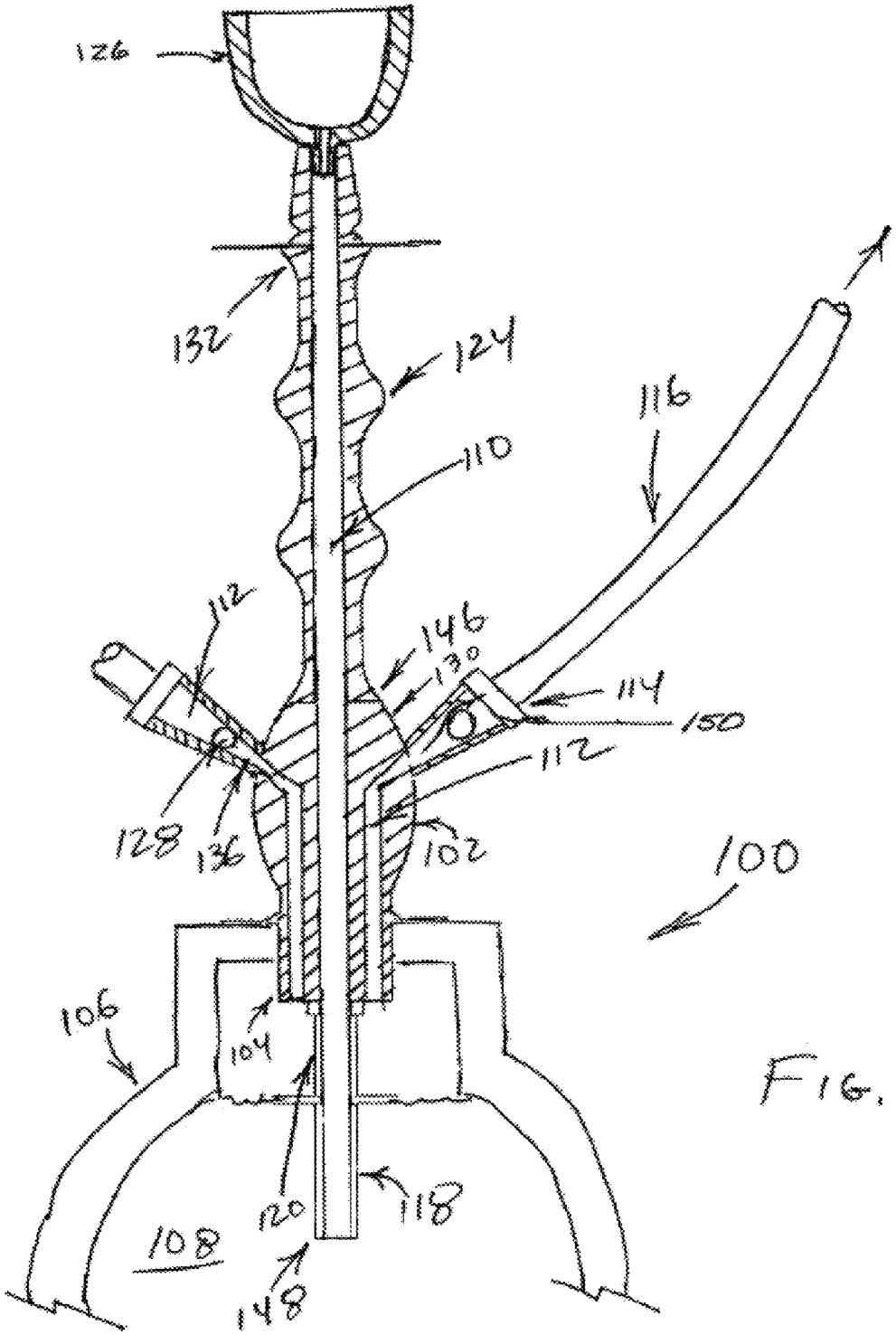
FIG. 1 shows a side, cross-sectional view of a multiple-user smoking apparatus according to a first embodiment of the invention.

FIG. 1 shows a multiple-user smoking apparatus 100, e.g. a hookah pipe according to a first embodiment of the invention. Multiple-user smoking apparatus 100 includes a stem 102 having a base 130 and a neck 124 projecting up from the base 130. A lower end 104 of base 130 is connected to a bottle 106 containing a fluid 108, for example it may be disposed insertably in bottle 106. Bottle 106 may be made of a material selected from the group consisting of acrylic, glass, Formica, quartz, plastic, and crystal.

Stem 102 includes a central passage 110. A plurality of peripheral passages 112 are formed around central passage 110 the base 130 of the stem 102, and communicate with an interior of bottle 106. A proximate end 114 of a hose 116 is connected to the stem 102 at a peripheral passage 112 by a one-way flow fitting 150.

As an alternative to discrete peripheral passages 112, an interior plenum may be defined within the base 130 of the stem 102. The interior plenum would be open to the interior of the bottle 106, and the down tube 118 would extend through the plenum. All hoses would be in communication with the plenum.

An upper end 120 of the down tube 118 is connected to the lower end 104 of the base 130 and extends into the bottle 106 below the surface of the fluid 108. The down tube 118 may be threaded at its upper end 120 for connecting it with mating threads (not shown) formed in the base 130. A burner cup 126 is mounted (such as by inserting an end thereof) at an upper end 132 of stem neck 124.

Bottle 106 may contain fluid 108, such as water or wine or a flavored water such as rose water.

In operation, one of several users of apparatus 100 inhales from a distal end of one of hoses 116. As long as the hoses 116 held by the other, non-inhaling users of smoking apparatus 100 are substantially closed off, the inhalation creates a draft through the smoking user's peripheral passage 112 from the interior of bottle 106. The draft creates a partial vacuum within the interior of bottle 106, reducing a pressure at the surface of fluid 108 and allowing wet smoke from fluid 108 to bubble up and escape. This in turn reduces the partial pressure within fluid 108, causing in turn a partial vacuum in central passage 110 and down tube 118 to burner cup 126 and drawing dry smoke down into fluid 108.

Figure 2:
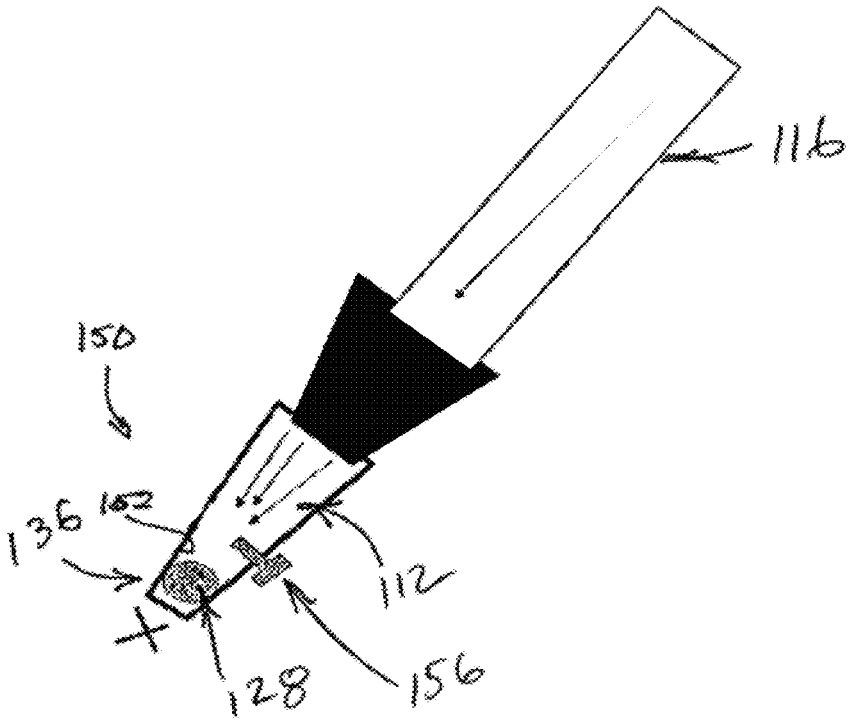
FIG. 2 shows a one-way flow fitting for use with an embodiment of the invention.

Referring now to FIG. 2, the one-way flow fitting 150 includes a stopper 128 (e.g., a ball) is disposed within the fitting body. The fitting 150 is secured to the base 130 of the stem 102 (preferably threaded) in alignment with one of the peripheral passages 112. An interior space with a frustoconical surface 152 is defined within the fitting body. A narrow end 136 of the surface 152, closest to the base 130, has a width that is less than that of the stopper 128 (i.e. the stopper diameter) and a wide end of the surface 152, further from the base than the narrow end, has a width that is greater than that of the stopper 128.

When one of several users of smoking apparatus 100 inhales from a distal end of one of hoses 116, stopper 128 in the fitting 150 associated with that hose 116 is drawn away from narrow end 136 of the interior frustoconical surface 152 by the draft, allowing wet smoke to traverse the passage 112, through the fitting 150 and around the stopper 128, and into the hose 116. Stoppers 128 in fittings 150 associated with the hoses 116 held by the other non-inhaling users of apparatus 100, on the other hand, remain at small end 136, retained there by the partial vacuum created in the interior of bottle 106. Thus the peripheral passages 112 associated with the hoses 116 held by the non-inhaling users of smoking apparatus 100 are substantially closed off by the stopper 128 wedged in the narrow end 136. Accordingly, the non-inhaling smokers need do nothing to close off their respective tubes. The draft created by the inhaling smoker will automatically close off all but his own smoking tube.

A pin 156 (e.g. a small screw), or other structure, is preferably disposed in a wall of fitting 150 to prevent stopper 128 from being drawn into hose 116 by inhalation.

Figure 3:
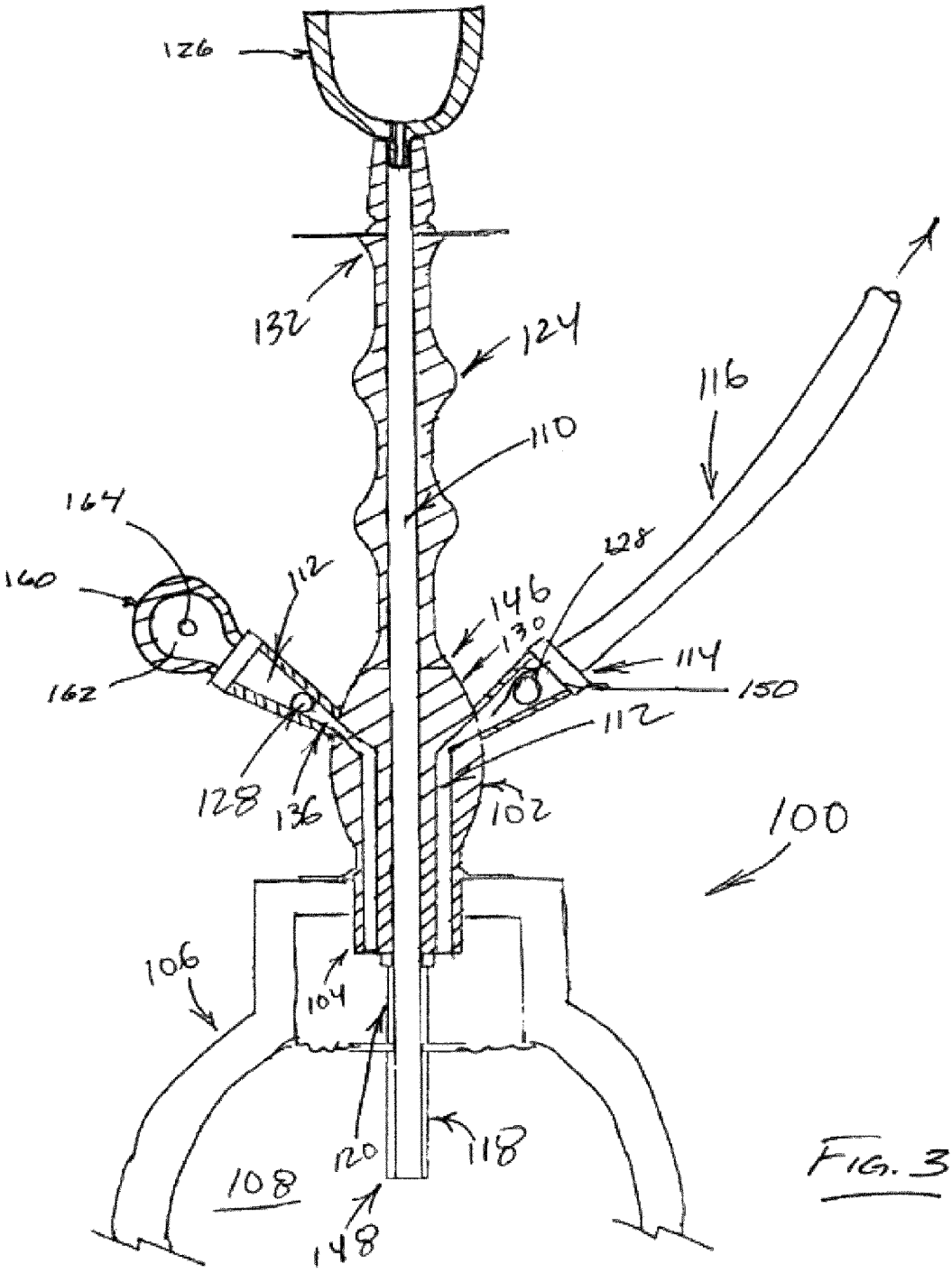
FIG. 3 shows a side, cross-sectional view of a multiple-user smoking apparatus according to an alternate embodiment of the invention.
Figure 4A:
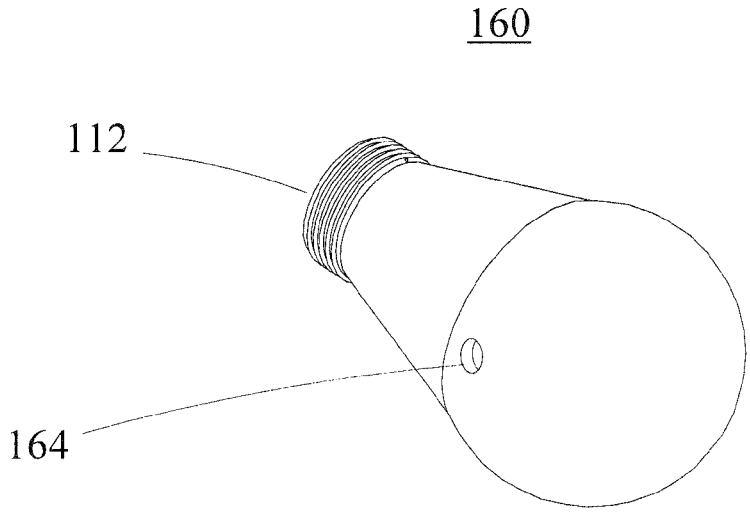
FIGS. 4A and 4B each show a perspective view of the exhaust valve of the present invention depicted in FIG. 3.
Figure 4B:
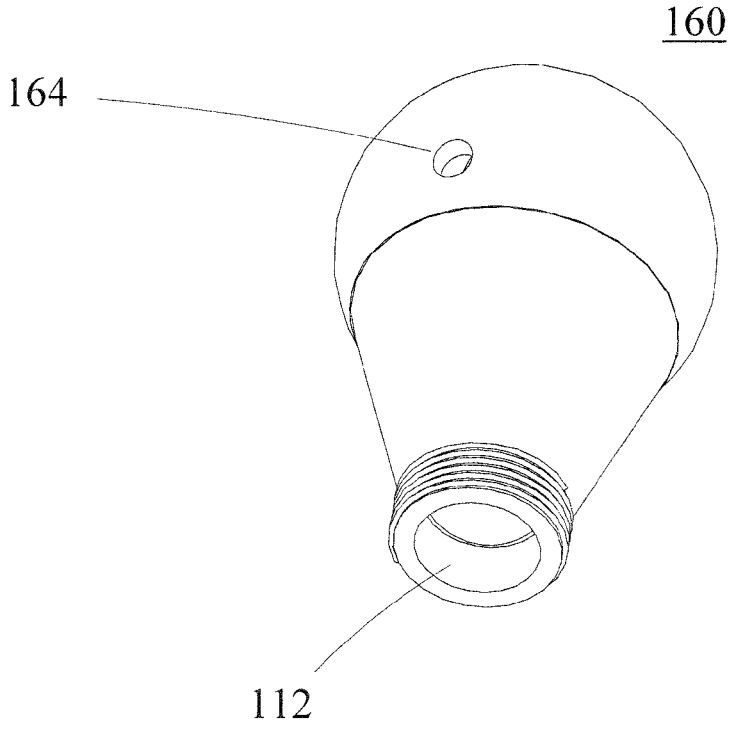

FIG. 3 depicts an embodiment of the present invention bearing a one-way flow fitting exhaust valve 160 and the one-way flow hose fitting 150. The pressure-release valve, or exhaust valve 160, like the hose fitting 150, couples or is affixed to the base 130 of the stem 102 (preferably threaded) in alignment with one of the peripheral passages 112. FIG. 4A and FIG. 4B depict in detail the exhaust valve 160.

The exhaust valve 160 is a flow fitting of the present invention that fits into the peripheral passage of the hookah base of the stem. Rather than include an aperture for accepting a hookah hose, the exhaust valve 160 possesses a body lacking sizable apertures. The exhaust valve 160 includes a body with a release port 164 in selective fluid communication with, and that permits external exhaust from, the peripheral passage 112. The body of the exhaust valve 160 may include any shape, configuration, and dimensions suitable to perform its task.

Figure 5:
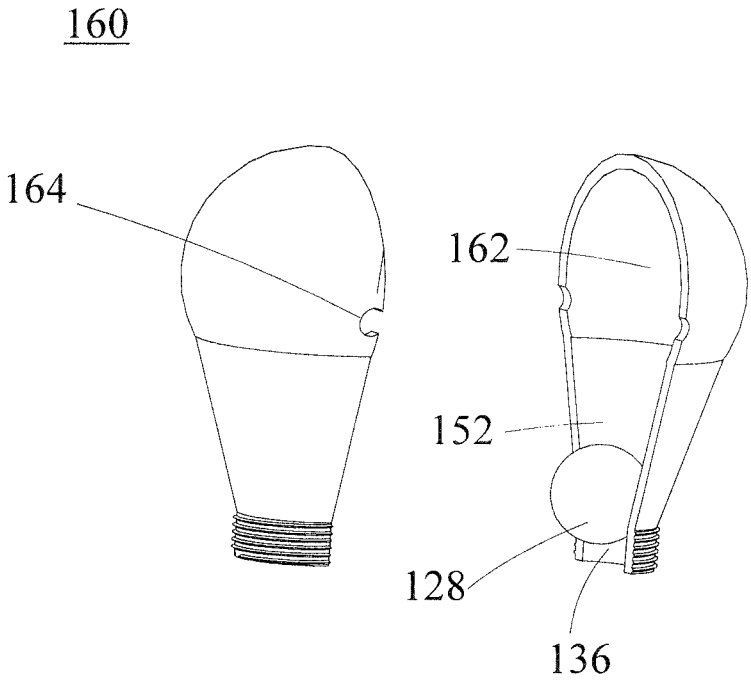
FIG. 5 shows a sliced, perspective view of the exhaust valve of the present invention depicted in FIG. 3.

As FIG. 5 shows, the selective fluid communication between the release port and the peripheral passage is controlled by the stopper 128 of the present invention. The exhaust valve includes an interior space with a frustoconical surface 152 within the exhaust valve 160 body. A narrow end 136 of the surface 152, closest to the base, has a width that is less than that of the stopper 128 (i.e. the stopper diameter) and a wide end of the surface 152, further from the base than the narrow end, has a width that is greater than that of the stopper 128. As FIG. 3 shows, the exhaust valve 160 is preferably used in conjunction with at least one hose fitting positioned in a stem base that draws from a common volume of air. The exhaust valve reacts to the negative net pressure created by the draw of air from a hose through a hose fitting by permitting downward actuation of the exhaust valve stopper 128 towards the stem base. The negative net pressure acts to seal the hookah and permit the user of the hookah a tight seal to enhance his draw of smoke from the hookah bottle. In such circumstances, the stopper 128 would be positioned as shown in FIG. 5.

Figure 6:
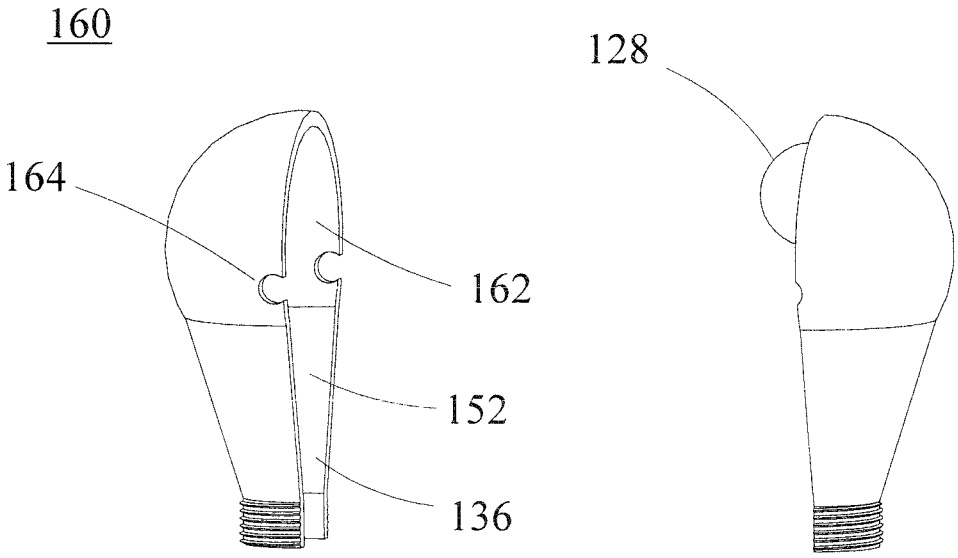
FIG. 6 shows a sliced, perspective view of the exhaust valve of the present invention depicted in FIG. 3.

FIG. 6 depicts the positioning of the exhaust valve stopper 128 in a positive bottle pressure situation. Positive net pressure urges the stopper through the frustoconical body of the exhaust valve to permit air passage around the stopper. The preferred dimensions of the exhaust valve 160 includes a bulbous stopper compartment 162 connected to the frustoconical interior portion 152. The stopper compartment 162 includes a substantially continuous surface from the frustoconical interior thereto to prevent the stopper from catching in transition stages and prevent the build-up of contamination in the interior of the exhaust valve. Upon an internal net pressure decrease, the stopper may roll back into a lower position. The stopper compartment 162 preferably permits substantial three-dimensional motion of the stopper therein. A bulbous exhaust valve is preferred as it presents a substantial, smooth interior surface.

The release port 164, in any quantity, is preferably located on the stopper compartment, and should be located on the exhaust valve at least a stopper's diameter from the connection between the stem base and the exhaust valve. The release port 164, or release ports in the aggregation, should have an area substantially smaller than the narrowest cross-sectional area of the passage 112 to which it connects. A preferred sizing of the release port 164 is between 20% and 80% of the narrowest cross-sectional area of the passage 112 to which the exhaust valve directly connects. The size of the release port 164 may vary greatly with the hookah with which it is used. A relatively decreased size permits a user to blow through a hookah hose into the hookah bottle and purge the bottle of stale smoke within. A release port sized to closer to the narrowest cross-sectional area of the passage 112 to which the exhaust valve directly connects will minimize the force applied to the air within the hookah bottle and will generally not permit a velocity adapted to the clear the smoke contents of the hookah bottle. A release port drastically smaller than the narrowest cross-sectional area of the passage 112 to which the exhaust valve directly connects will create excess pressure within the hookah bottle that may force the liquid therein through the exhaust valve—or even up the stem to the burner.

Modifications and variations of the present invention are possible in light of the above teachings. It is therefore to be understood that the invention may be practiced otherwise than as specifically described herein. Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A manual pressure-controlled hookah kit, said kit comprising:

a hookah bottle having a bottle interior;

a stem, configured to sealingly attach to said hookah bottle, with a base defining multiple, internal peripheral passages with uniform, external peripheral passage openings and leading to said bottle interior and with a neck defining a central smoke passage configured such that smoke travels from said central smoke passage into said bottle interior and then through said peripheral passages;

a pressure-release exhaust valve, with a lower portion adapted to releasably affix to any one of said uniform peripheral passage openings, having a body defining an interior void, comprising a tapered void portion leading to said lower portion of said exhaust valve and a bulbous void portion, that confines a floating exhaust stopper with a stopper diameter length therein and at least one release port positioned on said exhaust valve body at least said stopper diameter length from said stem base upon affixation thereto and substantially transverse to said interior void; and a hose fitting, defining a tapered interior void with a major portion dimensioned to internally accept a hookah hose and a minor portion defining a smoke inlet, said hose fitting with a lower portion adapted to releasably affix to any one of said uniform peripheral passage openings, wherein an aggregation of said release ports defines an area sized substantially smaller than said hose fitting interior void minor portion and further sized to effect purging of a substantial portion of gas within said bottle interior in response to moderate user pressure originating from said hose fitting, and wherein said hose fitting interior void is in gaseous communication with said exhaust valve interior void such that pressure exerted from said hose fitting interior void minor portion to said hose fitting interior void major portion forces said exhaust valve stopper toward said exhaust lower portion, and pressure exerted from said hose fitting interior void major portion to said hose fitting interior void minor portion forces said exhaust stopper toward said exhaust valve bulbous portion.

2. The kit of claim 1 wherein said hose fitting further comprises: an impediment, disposed within said void, dimensioned to partially obstruct said void and to allow substantial interior entry of a penetrative proximate end of a tapered hookah hose; and a floating spherical fitting stopper, disposed in said void between said smoke inlet and said impediment, dimensioned to selectively seal said void from the egress of wetted smoke.

3. The kit of claim 2 wherein said impediment is externally-accessible.

4. The kit of claim 3 further with at least two of the hose fittings of claim 3.

* * * * *